United States Patent [19]

Hannaford et al.

[11] Patent Number: 4,649,971

[45] Date of Patent: Mar. 17, 1987

[54] CROSSTIE BORING APPARATUS

[75] Inventors: John J. Hannaford, Downingtown; John J. Cunningham, Coatesville, both of Pa.

[73] Assignee: National Railroad Passenger Corporation, Washington, D.C.

[21] Appl. No.: 813,284

[22] Filed: Dec. 24, 1985

[51] Int. Cl.[4] ..... B27C 9/04

[52] U.S. Cl. ..... 144/3 H; 144/133 A; 144/365; 144/367; 408/26

[58] Field of Search ..... 144/3 R, 3 H, 92, 133 R, 144/133 A, 365, 367, 35 R; 408/22, 26

[56] References Cited

U.S. PATENT DOCUMENTS

| | | | |
|---|---|---|---|
| 1,610,623 | 12/1926 | Shipley | 144/3 H |
| 1,686,915 | 10/1928 | Lane | 144/3 H |
| 1,704,273 | 3/1929 | Alinder et al. | 144/3 H |
| 4,071,060 | 1/1978 | Busch | 144/3 H |

*Primary Examiner*—W. D. Bray

*Attorney, Agent, or Firm*—Kline, Rommel & Colbert

[57] ABSTRACT

A boring machine for preboring holes in railway ties on which a powered conveyor is supported for movement between input and discharge ends through a boring station between the input and discharge ends to extend transversely of the conveyor path. At the boring station transversely extending in side reference criteria are established in relation to which devices at the boring station position end lock each tie with its centerline and one end in a fixed relationship to the boring station reference criteria. Multi-spindle boring heads below the conveyor arranged in a predetermined relationship to the boring head transversely extending in side reference criteria are supported for vertical movement through a fixed distance with respect to the underside of the tie that bore holes in the tie underside in a fixed relationship relative to the tie centerline and one end. A marking device identifies the referencing end of the tie and a device adjacent the discharge end flips the ties placing the side containing the bored holes upwardly.

9 Claims, 3 Drawing Figures

CROSSTIE BORING APPARATUS

The present invention relates to a boring machine and more particularly to an apparatus for preboring beams, particularly wooden crossties on which railway rails are supported on the roadbed.

BACKGROUND OF THE INVENTION

Preboring of standard wooden crossties is a practice in the railroad industry which has received varying degrees of acceptance due to cost and accuracy of the historical operations. Most prior art applications of preboring have been made at tie treatment plants to new ties, after requiring reboring during installation of the crosstie at the job site.

Boring machines commonly in use for boring railway ties are gang arrangements of single boring spindles. Referencing of the crosstie was limited to end gauge reference and single stops to position ties at the boring heads. In general, all known boring machines and operations have been unable to consistently produce gauge accuracy acceptable to railroad construction standards on a productive basis.

SUMMARY OF THE INVENTION

It is therefore an object of the present invention to provide an apparatus for preboring wooden crossties with varying drill patterns to accommodate different rail plates that are manufactured for the railroad industry.

It is a further object of the present invention to provide such an apparatus which will prebore wooden crossties of varying widths and heights with a precise pattern of holes arranged in highly consistent accuracy with respect to the tie centerline and one end.

Broadly, the apparatus for preboring wooden crossties in accordance with the present invention comprises a framework supporting a tie conveyor for transporting ties from an input conveyor along a path extending the length of the machine framework to pass through a boring station extending transversely of the path of the conveyor, the boring station having a lengthwise and vertically exetending central reference plane and tie end stop at one end. Devices operable in a semi-automatic sequence are provided to position and clamp each tie conveyed into the boring station with one end of the tie in contact with the tie end stop and the center line of the tie coincident with the boring station central reference plane. Multi-spindle boring heads arranged in a predetermined patterned and spaced apart in a predetermined relationship relative the boring station central reference plane and the tie end stop are supported for vertical movement through a fixed distance relative to the conveyor path in a semi-automatic sequenced operation associated with that of the tie positioning and clamping operation. A tie marking device identifies that end portion of a tie of which the end is placed in contact with the tie end stop at the boring station. A tie flipping device located between the boring station and the discharge end of the machine flips each bored tie such that the bored holes of the tie are on its top side. Power for operating the machine, an operator's control station, engine shut down switches and means for clearing the machine of boring spoils are provided.

DESCRIPTION OF THE INVENTION

The present invention is further illustrated and described with reference to the annexed drawings wherein.

Figure 1:
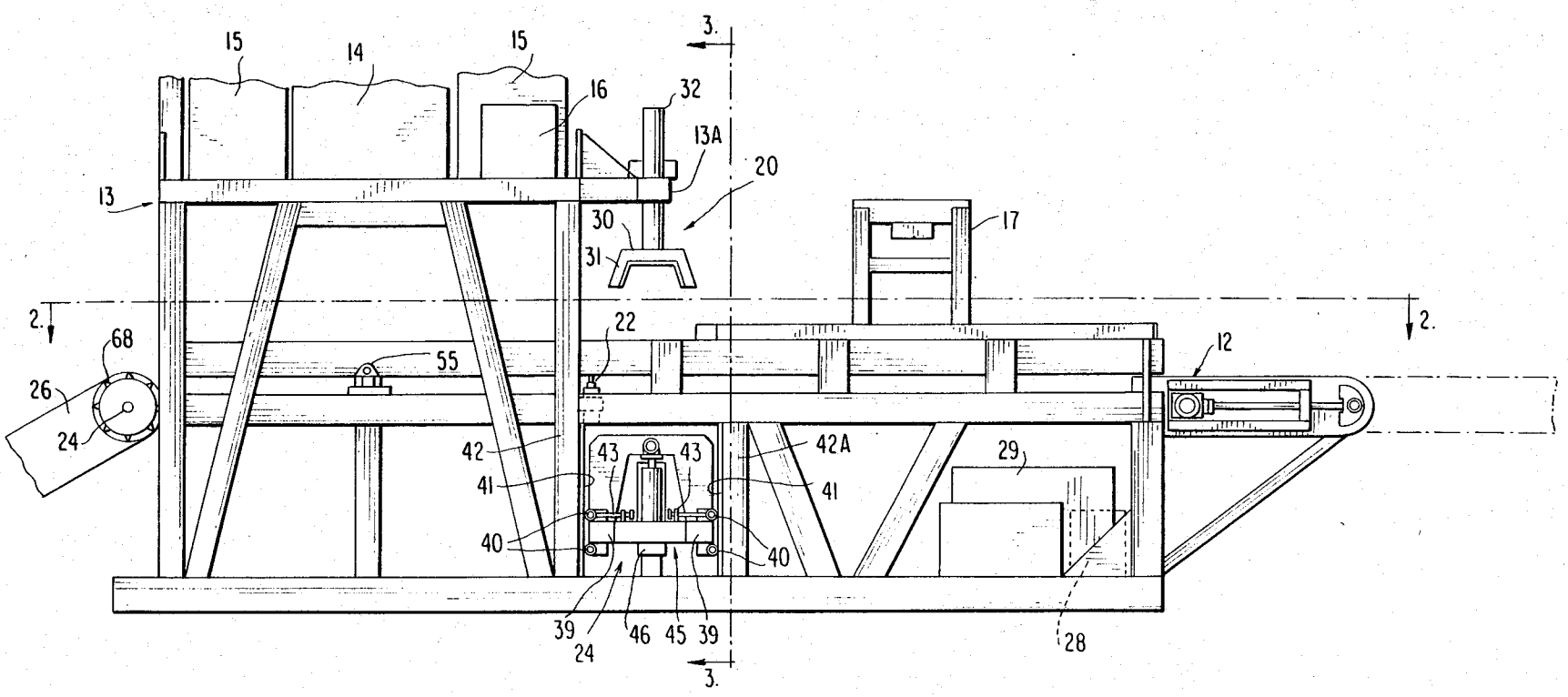
FIG. 1 is a side elevation of the preboring apparatus.
Figure 2:
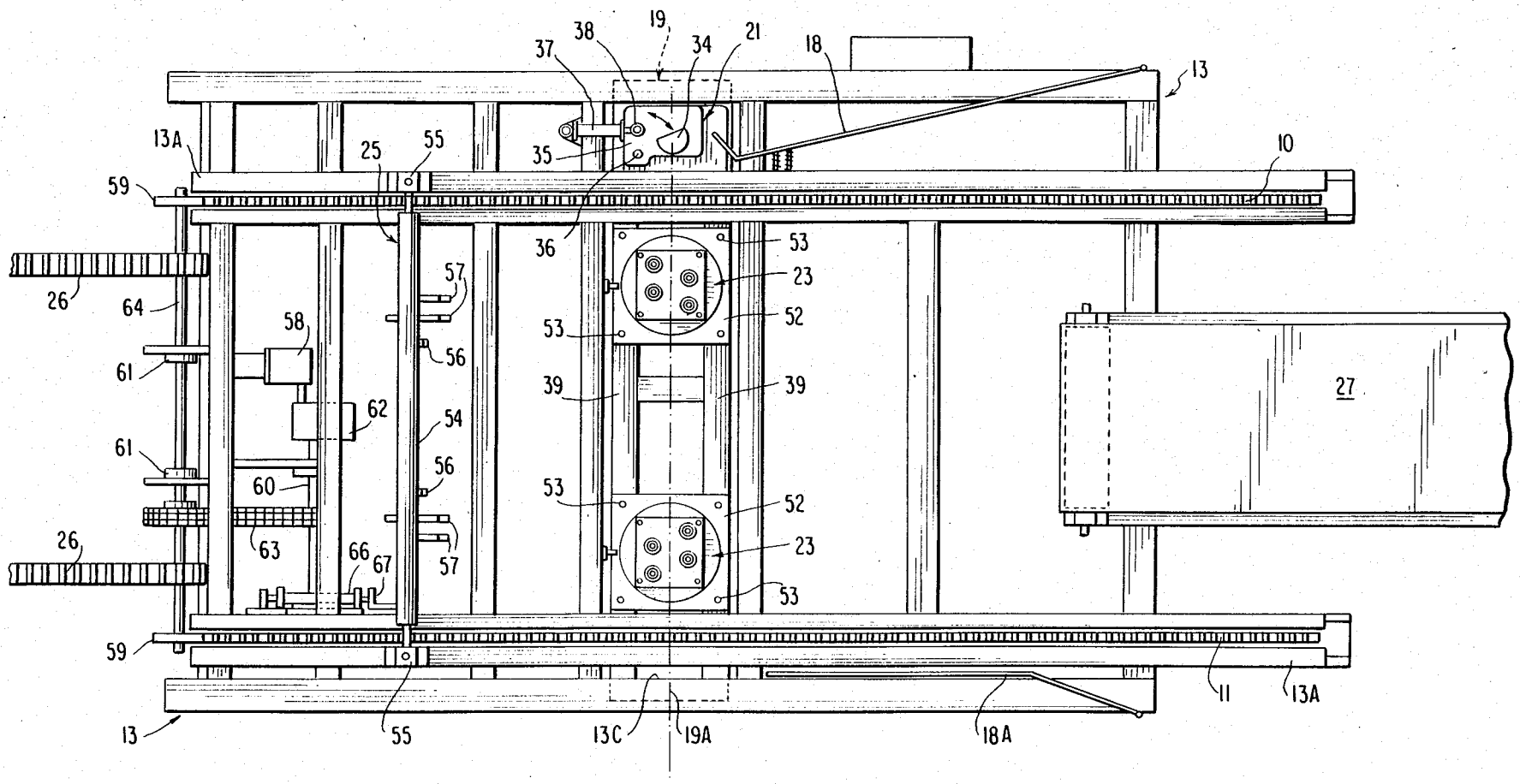
FIG. 2 is a top view of the apparatus illusted in FIG. 1 taken along section line 2—2 of FIG. 1.

First referring to FIGS. 1 and 2, a pair of sprocket driven tie conveyor chains 10, 11 having upwardly extending teeth (not illustrated) at spaced intervals with conventional slack adjuster 12 at the input end are each supported in tracks 13A extending along the length of each side of the apparatus main frame structure 13. Power for the operating components of the machine is provided by a diesel engine 14 that operates three hydraulic pumps supplying power to the operating components through conventional pipes and tubing, oil and fuel tanks 15 and battery 16 at a power station supported by the main frame 13 at the discharge end of the machine and by a generator 28 and vacuum pump 29 supported at the input end of the frame. The tie conveyor chains and other subsequently described components involved in the semi-automatic sequencing operation of the tie boring operations are controlled by an operator located at the operational panel 17 supported by members on the top portion of the main frame 13.

A spring-loaded, preliminary tie positioner flat plate 18 is pivotally mounted on the main frame to extend lenghtwise of the outer side to subtend an acute angle with a conveyor chain 10. A flat plate 18A is supported by the frame on the opposite side of and parallel to the other conveyor chain 11. Midway of the main frame 13 within the boundaries of a boring station 19 extending tranversely of the main frame and containing a vertically extending central reference plane 19A, a tie clamping device 20, a tie end referencing device 21, a tie reference end identifying device 22 and a pair of boring head assemblies 23 supported by a vertically movable boring head support frame 24, to be subsequently described in more detail, are supported in general vertical alignment by members of the main frame 13. A tie flipping device 25 is located between the boring station 19 and the discharge end of the machine onto which a discharge conveyor 26 is attachable to the machine main frame. A sprocket driven, hydraulically controlled input conveyor 27 is positioned in horizontal alignment with and extends forwardly of the input end of the machine between the tie conveyor chains 10, 11.

Figure 3:
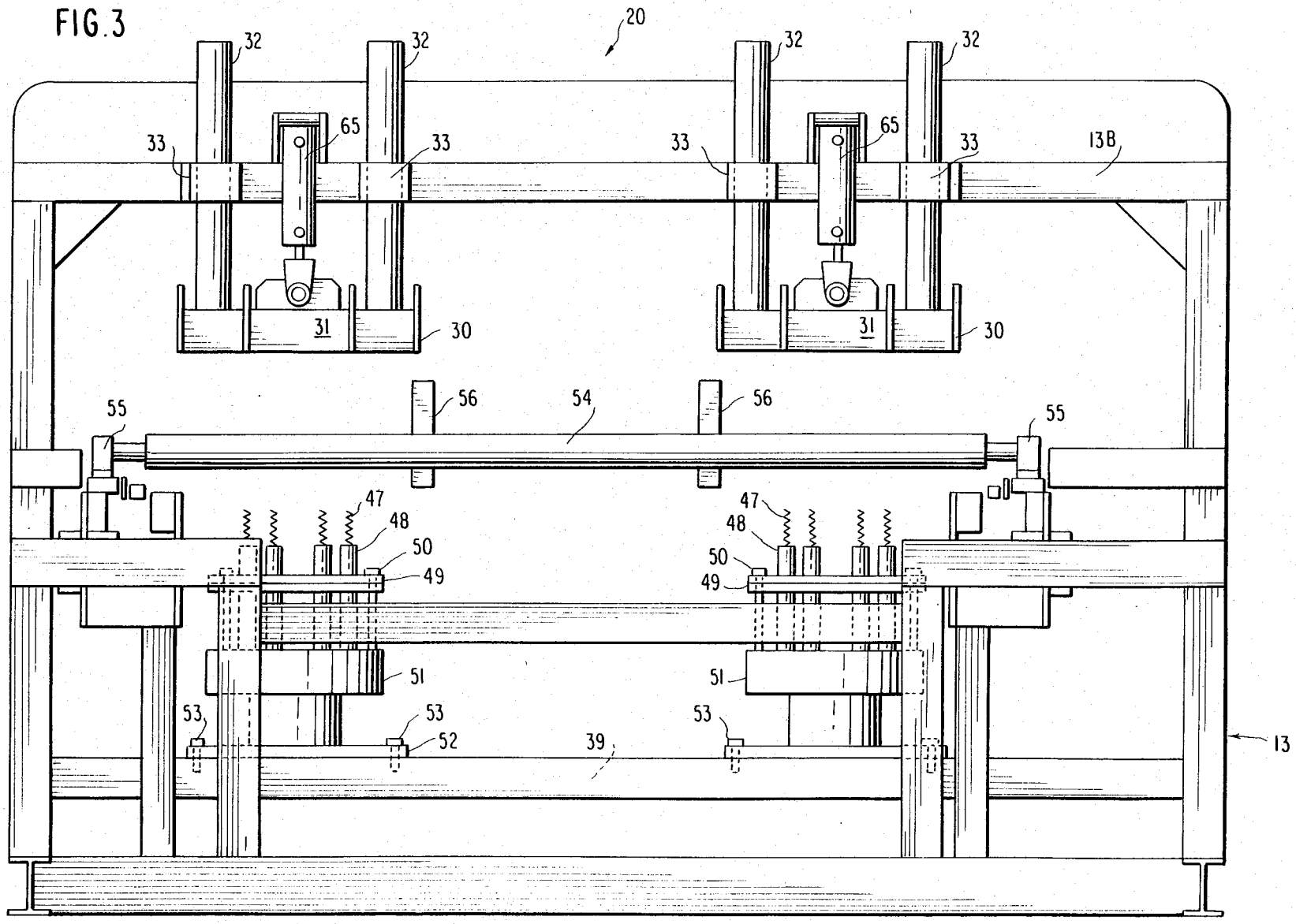
FIG. 3 is a cross sectional elevation taken along section line 3—3 of FIG. 1

Referring to FIG. 1 and the top portion of FIG. 3, the tie clamping device 20 comprises two hollow steel heads 30 having outwardly tapering sides 31 each fixed to and supported by vertically extending guide rods 32 movably supported for vertical movement through bearings 33 in the horizontally extending frame member 13A, each clamping head 30 being connected to a hydraulic cylinder 65 which raise and lower the tie clamping device 20.

Referring to FIG. 2, the tie end referencing device 21 comprises a half round stub shaft 34 extending vertically above a flat support plate 35 pivotally connected to a member on one side of the frame structure 13 by a pivot pin 36 and coupled to a hydraulic cylinder 37 by attaching pin 38 for swinging movement of the half round stub 34 about the pivot 36 upon actuation of the hydraulic cylinder. A tie end stop 13C is located on the main frame oppositely the side containing the tie end referencing device 21.

As shown in FIGS. 1 and 2, the vertically moveable boring head support device 24 comprises a pair of spaced apart frame bed members 39 extending transversely of the lower portion of the machine below the tie converyor chains 10, 11 and connected at their respective ends by end members 44 to form a transversely extending bed 45 that is supported for vertical movement by rollers 40 engaging in track slots 41 in vertically extending members 42 and 42A. Hex nuts and threaded rods 43 by which support bases of the rollers 40 are joined to the boring head support bed 45 insure proper alignment of the support bed 45 by maintaining constant pressure of the rollers 40 in the slots 41 against the vertical frame members 42, 42A. Hydraulic cylinders 46 connected between frame members and each end of the bed 45 raise and lower the support bed 45.

The two boring head assemblies 23 generally depicted in FIG. 2 and illustrated in detail in FIG. 3 each comprise bits 47 and chucks 48 of boring spindles locked into a predetermined positions by pairs of templates 49 connected by bolts 50 to the underlying boring head base 51 lying atop the boring head attachment plate 52 which in turn attaches by bolts 53 to the transversely extending frame membes 39 of the vertically movable boring head support bed 45.

Four pairs of templates are provided for the six standards sizes of rails and are manually changeable to bore the six different patterns required to accommodate the desired rail size.

The tie referencing identifying device 22 illustrated in FIG. 1 comprises a small pneumatic driven rotary tool with a standard router bit and activated by a switch (not illustrated) mounted on a frame member in the line of movement of the ties that are supported for movement along the path of the tie conveyor.

The tie flipping device 25 appearing in FIG. 2 comprises a round tubular steel rod 54 extending transversely below the tie conveyor chains 10, 11 with its ends supported in bearings 55 mounted on members of the main frame 13 and to which two half round steel plates 56 are welded about one-third the distance from each end of the rod 54. Two square tubes 57 are welded to the rod 54 just outside each of the half round plates 56. Hydraulic cylinder 66 supported by the main frame has a connectin 67 to the flipping rod 54 for actuating the tie flipping device 25.

A hyraulic motor 58 at the discharge end of the machine suppplies power through a gear box 62 to drive shaft 60 and driving chain 63 to rotate the conveyor chain drive shaft 64 at the ends of which the driving sprockets 59 for the tie conveyor chains 10, 11 are keyed. As shown in FIG. 1, discharge conveyor drive sprockets 68 are also keyed to the conveyor drive shaft 64 to drive the discharge conveyor 26.

A production counter (not illustrated) operated by switches actuated by movement of the boring head assembly 23 and the tie flipping device 25 is located at the operator's station. Air piped from an engine mounted compressor is discharged from outlets adjacent the boring head assemblies 23 through an air valve operable by the machine operator to clear the boring head area of drilling spoils.

The ties to be bored are mounted into contact with the upstanding teeth of the tie conveyor chains 10, 11 by the spocket driven, hydraulically controlled input conveyor 27 shown in FIG. 2. As each tie is moved from the input conveyor 27 into contact with the tie conveyor chains 10, 11, the tie ends are brought into contact with both flat positioning plates 18 and 18A to preliminarily center each tie midway of the conveyor path. After reaching the location of the boring station 19 the operator stops movement of the tie conveyor chains 10, 11 and the semi-automatic sequencing operation of boring the tie commences.

In the first sequencing operation the hyraulic cylinder 37 of the tie end referencing device 21 is actuated causing the half round shaft 34 to be swung into contact with one end of the tie at the boring station and push it lenghthwise to place the other end into solid contact with the tie end stop 13C. The second semi-automatic sequencing operation actuates the hydraulic cylinder 65 shown in FIG. 3 of the tie clamping device 20 illustrated in FIG. 1 which causes the clamping heads 30 to be lowered and bring the interior of its tapered sides 31 into contact with the sides of the tie at the boring station to cause the center line of the tie to be brought into congruence with the boring station central reference plane 19A shown in FIG. 2 irrespective of the width or the heighth of the tie. While maintaining referencing and centering pressure on the tie by operation of the tie end referencing and tie clamping devices 21 and 20, the third semi-automatic sequencing operation of boring the tie from below is initiated by actuating the hydraulic cylinders 46 of the boring head support device 24 shown in FIG. 1 to raise the bed 45 of the boring head support device, on which the boring head assembly 23 is supported, to bring the rotating bits of the boring head assembly 23 into contact with the underside of the tie and bore holes into the tie underside in a precise pattern at a predetermined location with respect to the tie center line and its reference end. The hydraulic cylinders 46 that raise the boring head support bed have adjustable stops that allow holes to be bored into the tie to a predetermined depth. To identify the reference end of the tie for the purpose of uniform installation on the roadbed, the router bit of the tie reference end identifying device 21 is actuated by a switch engaged by the tie during its movement along the conveyor path to skive a line along the entire width of the tie.

After the boring operation is completed the hydraulic cylinders of the previously described tie referencing, clamping and drilling devices are actuated in reverse of their initial actuation to release the bored tie, after which movement of the tie conveyor chains 10, 11 is again initiated and the bored tie moves toward the tie flipping device 25 illustrated in FIG. 1 for contact with the half round plates 56 welded to the rotatable rod 54 of the tie flipping device 25, initiating rotation of the flipping device rod 54 by actuation of the hydraulic cylinder 66 by an electric switch located on the machine side frame upon being contacted by a tie as it leaves the boring station. Rotation of the flipping device rod 54 swings the half round steel plates 56 upwardly against the bored tie to cause the tie to be rotated 180°. As the flipping device rod and attached half round plates 56 and square tubes 57 continue in rotation, the ties slides off the half round plates 56 onto the square tubes 57, after which the tie slides off onto the discharge conveyor 26. The action of the flipping device assures positioning the tie with the bored holes on top and slows the impact of the tie onto the discharge conveyor 26.

Although the described apparatus of this invention was conceived and developed for the purpose of boring railway roadbed crossties, it could be utilized to establish highly accurate boring patterns in precisely established locations with respect to the center line and one end of any type of beam.

Whereas, the present invention has been described in particular relation to the disclosed structure of the attached drawings, it should be understood that other and further variations of the invention as described may be made within the spirit and scope of this invention.

What is claimed is:

1. An apparatus for preboring railway ties comprising an elongated structural frame, a conveyor supported on said frame for movement along a path extending between input and discharge ends of said frame and conveyor and adapted to support ties arranged transversely of said conveyor path at spaced intervals, controlable power means for moving said conveyor along said conveyor path, a boring station having boundaries extending transversely of said frame between said input and discharge ends and within the boundaries of which a vertically extending central referenced plane is defined to extend lenghthwise of of the boring station, a tie end stop supported within the boundaries of and at one end of said boring station and having its inner surface perpendicular to said boring station central reference plane, tie end referencing means for moving a tie at said boring station axially and supported for movement transversely of said conveyor path between retracted and extended positions, said tie end referencing means in its extended position being in axially pressing contact with one end of said tie at the boring station and the other end of said tie in firm contact with said tie end stop, power means for moving said tie end referencing means between said retracted and extended positions, an elongated tie clamping head having a longitudinally extending center line and adapted to establish coincidences between said head center line and the center line of a tie in pressing contact with said head, said tie clamping head being supported for vertical movement between retracted and extended positions with said head center line in congruence with said boring station central reference plane, said tie clamping head in its extended position being in vertically directed pressing contact with sides of a tie extending lengthwise of said boring station, power means for moving said clamping head between said retacted and extended position, a boring head assembly having at least one powered boring spindle operable to drill holes, means supporting said boring head assembly for vertical movement a fixed distance between retracted and extended positions with said boring head assembly being arranged thereon in a predetermined relation to said boring station central referenced plane and to a vertical plane containing said tie end stop and perpendicular to said central referenced plane, and power means for moving said boring head support means between said retracted and extended positions.

2. The apparatus of claim 1 additionally comprising means for identifying that end of each tie having the ends of said end portion in contact with said tie end stop.

3. The apparatus of claim 1 wherein said clamping head has outwardly tapering longitudinally extending side walls between which a cavity of uniform of cross section is defined in which the cavity centerline coincides with the centerline of a tie contained within the cavity with both longitudinal sides of the tie in contact with opposite ones of said side walls.

4. The apparatus of claim 3 wherein said tie end referencing means comprises a cam and cam supporting means rotatable about a pivot spaced from said cam for establishing a horizontal swinging motion of said cam in the movement of said tie referencing means between its retracted end extended positions.

5. The apparatus of claim 4 wherein said cam comprises a cylindrically contoured shaft and said cam supporting means comprises a flat plate onto which said shaft is affixed.

6. The apparatus of claim 3 wherein said boring head assembly supporting means is spaced below said conveyor such that in the extended position of said supporting means the boring spindle of said boring head assembly penetrates a predetermined distance into the underside of a tie supported at said boring station.

7. The apparatus of claim 6 additionally comprising means located between said boring station and said frame discharge end for contacting and flipping over each bored tie conveyed thereby placing the bored hole side of the tie uppermost before reaching said discharge end.

8. The apparatus of claim 7 wherein said flipping means includes a rod supported for rotation about its axis extending transversely of and below said conveyor path, means for rotating said rod about its axis and a plurality of fingers affixed at spaced intervals along said rod to extend transvesely of said rod in a pattern adapted to contact and flip through 180° each tie passing there over upon rotation of said rod.

9. The apparatus of claim 3 additionally comprising an upstanding first guide plate affixed to said frame input end to extend lengthwise of and along one side of said conveyor path, a second upstanding guide plate having one end pivotally supported by a pivot on said frame end input end on the side opposite that of said first guide plate to extend lengthwise of and angled inwardly toward the centerline of said conveyor path, and biasing means extending between said frame and the end portion of said second guide plate opposite said pivotally supported one end.

* * * * *